United States Patent [19]

Oppl et al.

[11] Patent Number: 4,802,329

[45] Date of Patent: Feb. 7, 1989

[54] COMBINED SPINDLE AND BOBBIN

[75] Inventors: Günther Oppl, Hammelburg; Hermann Pickel, Schondra-Schildeck; Horst Rauch, Elfershausen, all of Fed. Rep. of Germany

[73] Assignee: FAG Kugelfischer Georg Schafer (KGaA), Fed. Rep. of Germany

[21] Appl. No.: 101,816

[22] Filed: Sep. 28, 1987

[30] Foreign Application Priority Data

Oct. 17, 1986 [DE] Fed. Rep. of Germany ..... 3635338

[51] Int. Cl.[4] ..... B65H 75/02

[52] U.S. Cl. ..... 57/129

[58] Field of Search ..... 57/129, 130, 131, 132; 242/118, 118.5

[56] References Cited

U.S. PATENT DOCUMENTS

| | | | |
|---|---|---|---|
| 2,463,484 | 3/1944 | Gelpke | 57/129 |
| 2,485,093 | 10/1944 | Gelpke | 57/130 |
| 2,493,902 | 1/1950 | Slocombe et al. | 242/118.5 |
| 2,510,292 | 6/1950 | Pierce | 57/130 |
| 3,404,851 | 10/1968 | Pfarrwaller | 242/118.5 |
| 3,406,512 | 10/1968 | Stahlecker | 57/132 X |
| 3,430,876 | 3/1969 | Sandager | 57/129 X |

FOREIGN PATENT DOCUMENTS

| | | |
|---|---|---|
| 3506386 | 8/1986 | Fed. Rep. of Germany . |
| 301102 | 11/1928 | United Kingdom . |
| 716045 | 9/1954 | United Kingdom . |
| 892152 | 3/1962 | United Kingdom . |
| 1007616 | 10/1965 | United Kingdom . |
| 1172695 | 12/1969 | United Kingdom . |

*Primary Examiner*—Donald Watkins

*Attorney, Agent, or Firm*—Ostrolenk, Faber, Gerb & Soffen

[57] ABSTRACT

With the constant increase in spindle speeds, the attachment of the bobbin to the spindle becomes more difficult. To avoid detachable bobbins, the bobbin is integrated with the spindle. The spindle is installed together with its integrated bobbin. Yarn is wound on the spindle bobbin. In a modified version, there is a bobbin core tube firmly attached around and on the spindle core.

12 Claims, 4 Drawing Sheets

COMBINED SPINDLE AND BOBBIN

BACKGROUND OF THE INVENTION

The present invention relates to a spindle for rewinding, respooling or twisting yarn wherein the spindle core is constructed as a bobbin.

With the constant increase in spindle speeds, the accurate mounting of the bobbin on the spindle for all conditions of operation becomes increasingly difficult to achieve and maintain.

Traditionally, attachment of bobbins has been by so-called adapters, the inner diameter of the bobbin being adjusted to the spindle core or being axially secured by a bayonet lock. The required precision of the bobbins, which are made predominantly of aluminum, plastics or a combination of the two materials, can frequently not be achieved and they are thus not suitable for high speeds of spindle rotation.

A further problem is the balancing of the bobbins, as yarn imbalance jeopardizes bobbin balance, no matter how accurate it may originally have been.

As is known, with high speeds of rotation of the spindle, the bobbins must receive a tighter winding of the yarn, since as a result of the centrifugal force, the turns loosen themselves from the bobbin during rewinding or respooling. This means that the fully and tightly wound bobbin has a small bobbin diameter that becomes increasingly larger as the yarn unwinds, which leads to radial play of the bobbin. A very high degree of monitoring of the quality of the bobbins becomes necessary.

Another problem arises from the large number of bobbins used. At least three bobbins are necessary for each spindle unit, since they are variously positioned at different times at different locations, for instance, where the device is used as a spinning machine or a winding machine. The constant transport of the bobbins also does not contribute to the improvement of their quality, since damage may result.

Another disadvantage is that the boreholes of the bobbin seats become larger as a result of repeated displacement and eventually become unusable. The vibration of the spindle plays a very large role. The bobbins are applied to the spindle by means of a slide seat so that radial play must be present. This, in turn, is affected by the vibration of the spindle which also leads to enlargement of the boreholes of the bobbins, increased load on the mounting and thus premature failure of the spindles.

Since the rewinding, respooling or twisting spindle is not identical to the spool spindle, this requires a substantial additional expense for stocking spare parts and repair equipment.

In German Federal Republic Published Application OS No. 35 06 385, a bipartite spindle comprising a bobbin unit and a mounting unit is described. A spindle of this kind has disadvantages. Upon the replacement of the bobbin, the long shank of the bobbin is a disadvantage. Furthermore, a corresponding free space is required in the machine above the spindle so that the bobbin can be removed from the mounting unit and can be reinserted. This free space is not available in modern machines which are designed in compact and operator-friendly fashion.

In addition, the spindle core, which must be manufactured with high precision, is very sensitive. Slight blows, which invariably occur upon transport of the bobbin, impair the movement of the spindle and lead to premature failure of the spindle.

The precision of the fit of the spindle core to the mounting bushing can be obtained only at great financial expense. With this type of spindle design, the precision of the fit is reduced upon each change of bobbin. There is the additional factor that the bobbin shank must in each case have a slide seat, which leads to radial play. The vibrations acting on the spindle have a substantial detrimental effect on this radial play and exert a negative influence on the loading and life of the mounting.

BRIEF DESCRIPTION OF THE INVENTION

It is therefore the principal object of this invention to create a spindle of the aforementioned type which avoids the above indicated disadvantages.

This object is achieved by constructing and shaping the spindle core as a bobbin or firmly securing a bobbin core tube on the spindle core, e.g. by press or shrink attachment, particularly for enabling the rewinding, respooling or twisting spindle to be identical to the spool spindle on a spooling machine.

Further, in the invention, the spindle core bobbin is formed so that its mass is a multiple of the mass of the yarn and is precisely balanced out to residual eccentricity whereby the imbalance of the wound yarn is negligible.

Further, in the invention, specific materials and procedures are used so that a bobbin core tube will be firmly anchored on the spindle core by a press or shrink fit. The bobbin core tube may be comprised of hardened steel, or, depending on the quantity of yarn to be processed, the bobbin core tube may be comprised of high-strength aluminum or of high-strength plastic.

Bobbin limiting plates are placed on the upper and lower ends of the bobbin core tube or of the spindle core. Vertical adjustability of the upper bobbin limiting plate is provided. Run off aids toward the outside of the bobbin limiting plates, such as runoff bevels, may be provided. There is also a winding protection labyrinth on the spindle mounting side of the lower bobbin limiting plate. Further, a quick-lock device is used for the spindle.

The spindle of the invention is so designed that only one spindle is required for the rewinding, respooling, twisting or spooling process, in that the spindle core is constructed and shaped as a bobbin. This is done in such manner that the yarn is already wound on the outside diameter of the spindle core or else, in the case of large yarn weights, a bobbin core tube is pressed or shrunk onto the spindle core and the yarn is thereafter wound on it. This substantially increases the spring stiffness of this bobbin, which results in a displacement of the points of resonance toward higher spindle speeds.

Deformation of the tube, even in the case of extremely hard winding, is not possible here. Furthermore, the relatively large mass can now be accurately balanced. A change in the balance, which always takes place with traditional bobbins, is not possible.

A large financial advantage results in the elimination of many different bobbins and types of bobbins since the bobbin size is adjustable on the spindle core. Similarly, all adapters and other fastening elements for the bobbin are dispensed with.

In addition to the advantages indicated, it is also possible to operate the spindle via a motor which is either integrated into the spindle or else can be driven by drive elements, such as toothed belts, or the like.

BRIEF DESCRIPTION OF THE DRAWINGS

The foregoing and other objects and features of the invention will become apparent in the following description and accompanying drawings in which.

DETAILED DESCRIPTION OF THE INVENTION

Figure 1:
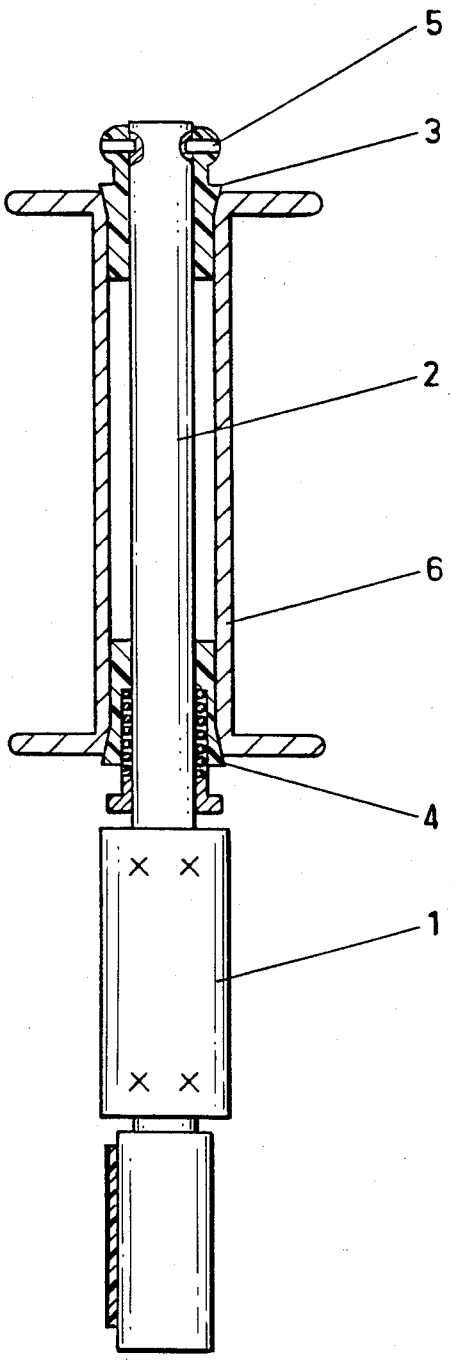
Fig. 1 PRIOR ART
FIG. 1 is a traditional rewinding spindle with adapter bobbin attachment.

Referring first to FIG. 1, a traditional prior art rewinding spindle is there shown. In this case the bobbin 6 is held by the adapters 3 and 4 which are arranged on and affixed along the spindle core 2. The adapters 3, 4 occupy part of the length of the spindle core and are required extra elements. The bobbin is unsupported radially in the axial space between the adapters. Axial securement of the spindle 1 is accomplished with the bayonet lock 5.

Figure 2:
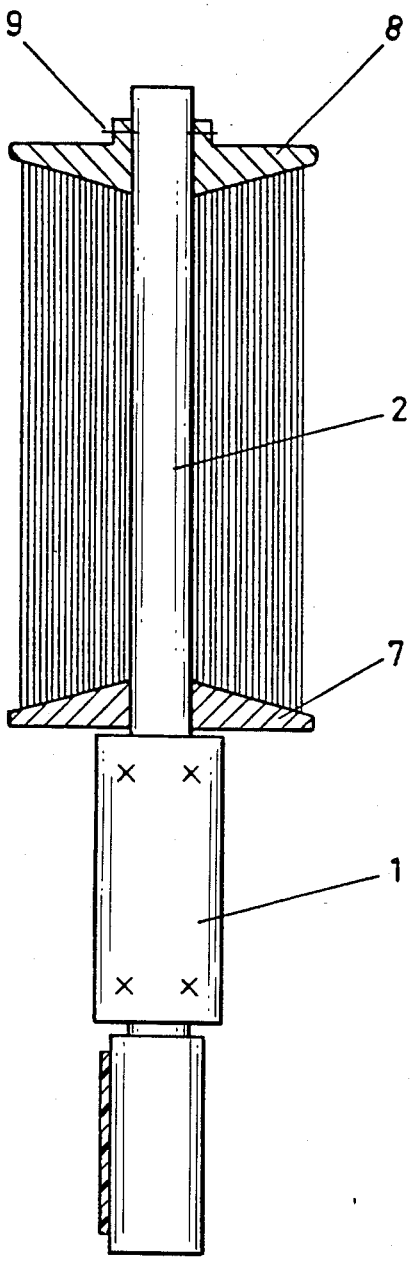
FIG. 2 is a spindle according to the invention, in which the yarn is wound onto the spindle core.

Spindle 1 of the present invention is shown in FIG. 2. The bobbin limiting plates 7 and 8 are arranged directly on the spindle core 2 and together with the spindle 1 form the spool. Arrangement of the device to facilitate vertical adjustment of the upper bobbin limiting plate 8 is shown at 9 in FIG. 2. This may comprise a pin insertable through the plate 8 into various receptacles along the spindle core 2.

The spindle core 2 has a mass as does the yarn spooled on the core. The mass of the spindle core which serves as a bobbin is greater, and preferably a multiple, of the mass of the warn wound on the core. The spindle core is also balanced out to residual eccentricity so that the imbalance of the wound yarn is negligible.

Figure 3:
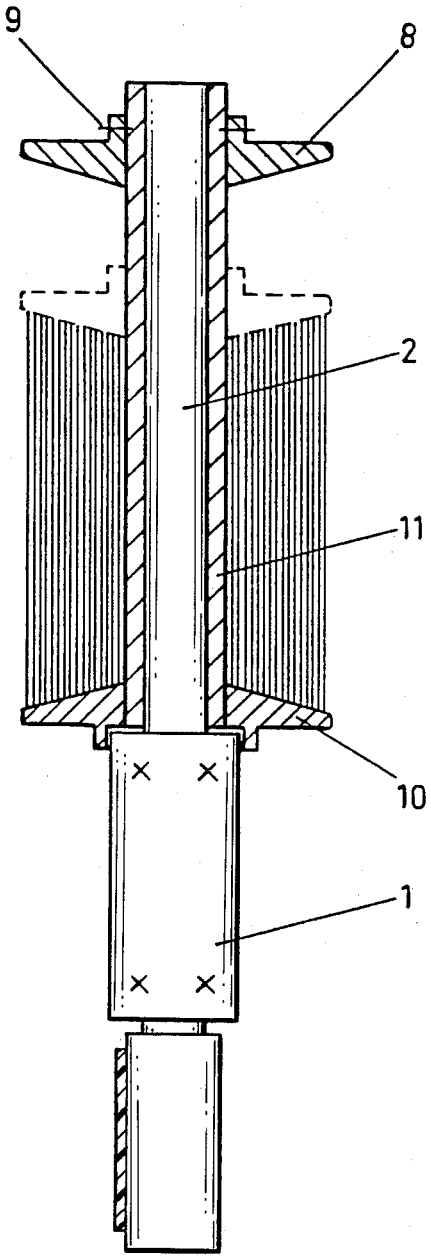
FIG. 3 is a spindle according to the invention having a spindle-core tube and adjustable bobbin size.

FIG. 3 also shows a spindle 1 of the invention. The bobbin core tube 11 in this case is shrunk onto the spindle core 2. The tube 11 sits against the spindle core 2 over the entire length of the tube 11. The bobbin limiting plates 8 and 10 are in this case arranged on the bobbin-core tube 11. The bobbin limiting plate 10 has a labyrinth packing on the side of the spindle mounting. The dashed-line position of the bobbin limiting plate 8 indicates the adjustability of the axial size of the bobbin.

Figure 4:
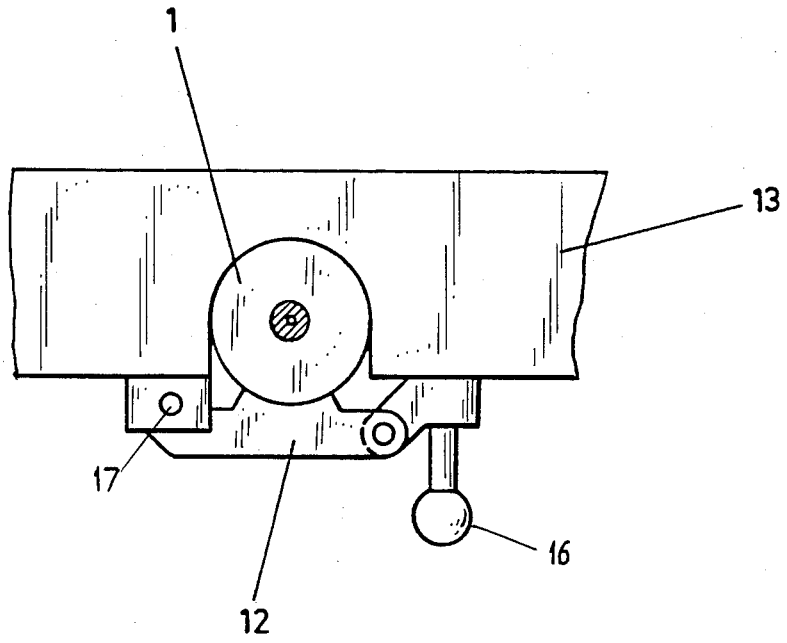
FIG. 4 diagrammatically shows a quick-locking device.

FIG. 4 diagrammatically shows the pivotable quick-lock 12 by which the spindle 1 is fastened in the spindle mounting plate 13. Moving the handle 16 laterally lifts the lock plate 12 off the spindle 1 around the pivot 17 and reverse movement of the handle resecures the plate 12 against the spindle.

Figure 5:
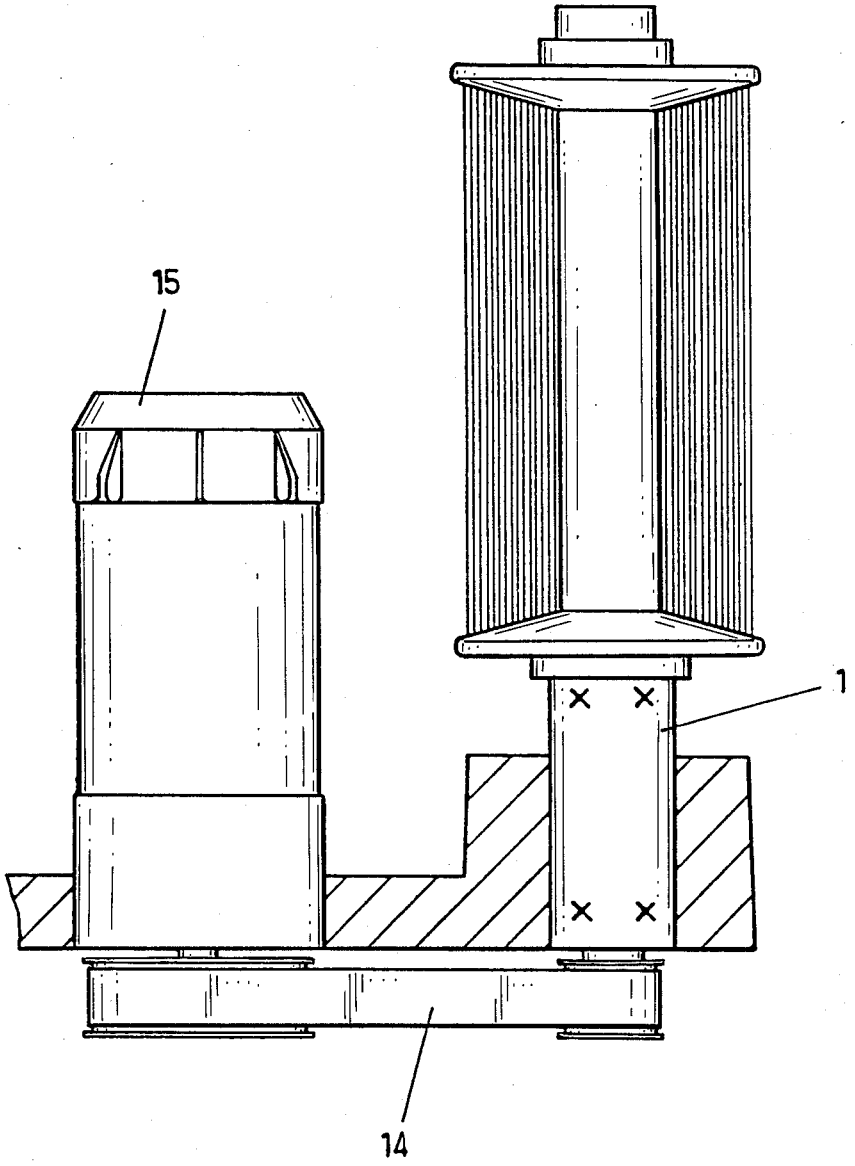
FIG. 5 is a motor-operated spindle.

FIG. 5 shows the spindle 1 of the invention, which is driven via a belt drive 14 from a motor 15.

The various objects, principles and methods shown herein epitomize the various aspects of the invention and are illustrative thereof. It is preferred, therefore, that the scope of this invention be determined, not by the specific disclosure herein set forth, but only by the appended claims.

What is claimed is:

1. A combination spindle and spindle core for the rewinding, respooling or twisting of a yarn, wherein the spindle comprises a rotatable spindle part and the spindle core is nonseparably supported to the rotatable part, the spindle core having an exterior that is constructed and shaped as a bobbin for directly receiving yarn thereon and for supporting yarn thereon.

2. A combination spindle according to claim 1, further comprising yarn wound on the spindle-core and wherein the mass of the spindle-core is a multiple of the mass of the yarn and is precisely balanced out to residual eccentricity, whereby the imbalance of the wound yarn is negligible.

3. A combination spindle according to claim 2, wherein the spindle core comprises a bobbin-core tube firmly anchored around and on the spindle core and contacting the spindle core inside of and over the full length of the tube.

4. The combination spindle of claim 3, wherein the bobbin core tube comprises hardened steel.

5. A combination spindle according to claim 3, wherein the bobbin-core tube comprises high-strength aluminum.

6. A combination spindle according to claim 3, wherein the bobbin-core tube comprises high-strength plastic.

7. A combination spindle according to claim 3, further comprising means for limiting the yarn to be wound, the limiting means comprising bobbin limiting plates arranged on the upper and lower ends of the bobbin-core tube.

8. A combination spindle according to claim 1, having comprising means for limiting the yarn to be wound, the limiting means comprising bobbin limiting plates arranged on the upper and lower ends of the spindle core.

9. A combination spindle according to claim 8, wherein the upper bobbin limiting plate is vertically adjustable toward and away from the lower plate.

10. A combination spindle according to claim 1, wherein the bobbin limiting plates have a yarn run-off aid towards the outside in the form of run-off bevels.

11. A combination spindle according to claim 6, wherein the lower bobbin limiting plate includes a winding protection labyrinth on its side away from the upper plate and wound yarn.

12. A combination spindle according to claim 1, further comprising a spindle mounting plate, and a quick-lock device for fastening the spindle on the spindle mounting plate.

* * * * *